United States Patent [19]

Furuya et al.

[11] Patent Number: 4,572,349

[45] Date of Patent: Feb. 25, 1986

[54] COIN CHECKING DEVICE FOR USE IN A COIN HANDLING MACHINE

[75] Inventors: Katusuke Furuya; Tomonari Sakurai, both of Tokyo, Japan

[73] Assignee: Laurel Bank Machine Co., Ltd., Tokyo, Japan

[21] Appl. No.: 561,379

[22] Filed: Dec. 14, 1983

[30] Foreign Application Priority Data

Dec. 16, 1982 [JP] Japan ..... 57-220552

[51] Int. Cl.[4] ..... G07F 3/02

[52] U.S. Cl. ..... 194/318

[58] Field of Search ..... 194/100 A, 97 R; 73/163; 324/243

[56] References Cited

U.S. PATENT DOCUMENTS 3,870,137 3/1975 Fougere ..... 194/100 A 4,462,513 7/1984 Dean et al. ..... 194/100 A

*Primary Examiner*—Stanley H. Tollberg

*Attorney, Agent, or Firm*—Fleit, Jacobson, Cohn & Price

[57] ABSTRACT

A coin checking device is provided in a coin handling machine for discriminating genuine coins from counterfeit. The coin checking device includes detection coils comprising a transmitting coil for generating an exciting voltage and a receiving coil for generating an induced voltage. The detection coils detect the passage of each coin and sequentially issue signals. The coin checking device also includes a controller which may be a computer. The controller receives signals from the detection coils and makes calculations on the basis of the values of the signals in accordance with a stored program to obtain a reference value. In the controller, the reference value is then compared with a predetermined acceptable value and the degree of any difference in the value thus obtained determines whether the coin is genuine or counterfeit. The reference value in the controller is constantly renewed on the basis of new signal inputs into the controller. The acceptable value can be varied by a coin kind setting switch provided for setting the kinds of coins to be checked.

4 Claims, 2 Drawing Figures

COIN CHECKING DEVICE FOR USE IN A COIN HANDLING MACHINE

BACKGROUND OF THE INVENTION

This invention relates to a coin checking device for use in a coin handling machine for discriminating genuine coins from counterfeit.

Conventionally, the discrimination of genuine coins from counterfeit has been effected by the detection of coin diameter, thickness, weight, material, etc. The following method has been used for discriminating the material properties of the coins: A pair of coils are mounted opposite to each other so that the coin path is located between the coils. An a.c. voltage is applied to one of the coils and when the coin passes between the coils, variation of voltage induced in the other coil is detected, and this variation value is compared against a predetermined reference value to determine what material the coin is made of.

In the above-mentioned method, the reference value is maintained to remain at a constant level. In such a case, discrimination errors are generated, by fluctuation of detection threshold level caused by variation of temperature, or drift arising in oscillators employed for applying such a.c. voltage to one of the coils or in amplifiers employed for amplifying such induced voltage. More specifically, when coins to be discriminated are of a very similar material (for example a 50 yen coin and a 100 yen coin, or a 500 yen coin and a (Korean) 500 won coin), the method is disadvantageous in that the differences in the said variation in induced voltage produced by the material of the coins are so slight that such level fluctuation caused by drift or variation of temperature gives rise to erroneous discrimination. Although in order to avoid such erroneous discrimination, there has been proposed means for suppressing level threshold fluctuation, this involves the use of a constant temperature bath or highly expensive low-drift elements.

SUMMARY OF THE INVENTION

It is, therefore, an object of the invention to provide a novel coin checking device for use in a coin handling machine which is less expensive and can maintain precise discrimination despite level fluctuations due to drift or variation of temperature.

According to the present invention, there is provided a coin checking device for use in a coin handling machine for discriminating whether passing coins are genuine or counterfeit, which comprises: detection coils for sequentially issuing detection signals in accordance with the material properties of each passing coin; and a controller for taking the maximum quantities of variation of the detection signals, calculating at least two maximum quantities of variation corresponding to the previously passed coins to obtain a reference value, then calculating the difference between the reference value thus obtained and a maximum quantity of variation corresponding to the currently passing coin, and issuing a different kind coin mixture signal when the difference exceeds a predetermined acceptable value.

BRIEF DESCRIPTION OF THE DRAWINGS

These and other objects as well as advantages of the present invention will become clear from the following description of a preferred embodiment of the present invention with reference to the accompanying drawings, wherein.

DETAILED DESCRIPTION OF THE PREFERRED EMBODIMENT

Figure 1:
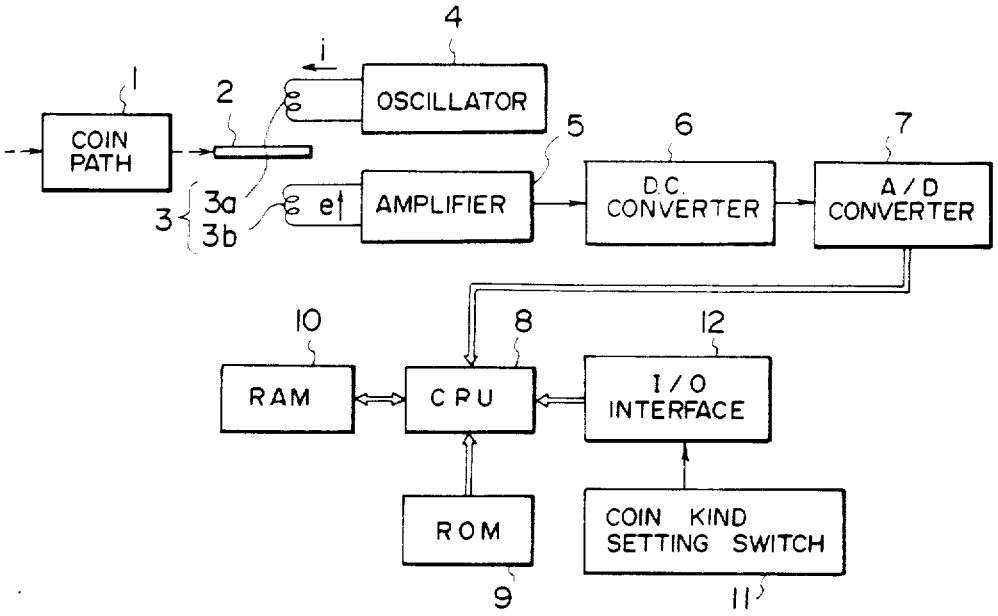
FIG. 1 is a block diagram showing one embodiment according to the invention.
Figure 2:
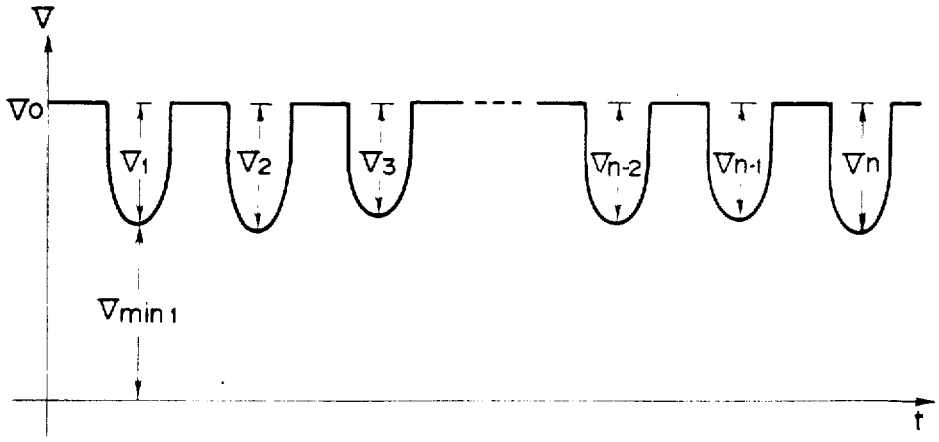
FIG. 2 illustrates maximum quantities of variation $V_1$, $V_2 \ldots V_n$.

In FIG. 1, a coin selecting path 1 serves to select coins which are transferred into the coin path in accordance with the profile size of the coins and to feed the coins thus selected toward the detection coils 3. The detection coils 3 comprise a transmitting coil 3*a* and a receiving coil 3*b*, which are mounted opposite to each other on either side of the coin path. An a.c. current i is supplied to the transmitting coil 3*a* from an oscillator 4, and the voltage thus induced in the receiving coil 3*b* is applied to an amplifier 5. The output voltage from the amplifier 5 is rectified and smoothed at a direct current converter 6, which issues a voltage V as shown in FIG. 2. FIG. 2 dipicts an initial voltage $V_0$ between detectors 3*a* and 3*b*. As coins 2-1 through 2-n are introduced between detectors 3*a* and 3*b*, a maximum variation voltage of $V_1$ through $V_n$ is measured. $V_{min\ 1}$ represents the difference between $V_0$ and $V_1$ for each coin as measured over time t. The voltage V is converted to a digital signal by an A/D converter (analog-digital converter) 7 and then supplied to a CPU (central processing unit) 8. The CPU 8 reads a control program from a ROM (read only memory) 9 and processes the signal on the basis of the control program and writes the data thus obtained in a RAM (random access memory) 10. A coin kind setting switch 11 serves to set which kind of coins are to be checked and discriminated. The coin kind setting switch 11 includes a dial, not shown, for selecting a particular kind of coins and may be of any type in which a coded signal corresponding to the selected kind of coins is generated. For example, the coin kind setting switch disclosed in U.S. Pat. No. 4,219,985 may be used. The output signal from the coin kind setting switch is supplied to the CPU 8 through an I/O (input-output) interface 12. Namely, the I/O interface 12 serves to transfer the coded signal from the coin kind setting switch 11 to the CPU 8. Furthermore, the CPU 8 reads the data (acceptable value) stored in the address of RAM 10 corresponding to the coded signal and the data thus read is used for calculation hereinafter described.

The operation according to the above-mentioned embodiment will be explained with reference to the discrimination of 100 yen coins.

In the case of the discrimination of 100 yen coins, an operator sets the coin kind setting switch 11 in a corresponding predetermined position and then depresses a start button, not shown. A first coin 2-1 is fed through the coin path 1 toward the detection coils 3. When the coin 2-1 passes between the transmitting coil 3*a* and the receiving coil 3*b*, the voltage e induced in the receiving coil 3*b* varies. More particularly, there is a voltage $e_o$ which is the voltage normally induced in the receiving coil 3*b* (that is, when the coin 2 is not intersecting the magnetic field between the transmitting coil 3*a* and the receiving coil 3*b*). However, when the coin 2-1 intersects the magnetic field between the transmitting coil 3*a* and the receiving coil 3*b*, the induced voltage e gradually drops to a voltage $e_{min\ 1}$ in accordance with the intersecting quantity and then gradually rises. When the coin 2-1 completes its passage between the coils 3*a* and 3b, the voltage e again returns to its initial voltage $e_o$. The output voltage V of the d.c. converter 6 varies from $V_o$ through $V_{min\ 1}$ to $V_o$ in response to the above-mentioned variation of the induced voltage e ($e_o \rightarrow e_{min} \rightarrow e_o$). The output voltage thus varies and is converted from analog to digital form by the A/D converter 7 and then supplied to the CPU 8. The CPU 8 detects the maximum quantity of variation, that is, $V_1 = V_0 = V_{min\ 1}$ and writes it into the RAM 10. Then, the first coin 2-1 is unconditionally treated as a genuine one and discharged into, for example, a counting bag, not shown.

When a second coin 2-2 passes the detection coils, similarly to the coin 2-1, the CPU 8 detects the maximum quantity of variation $V_2$ and writes it into the RAM 10. The previous maximum quantity of variation is taken as a reference value and calculation of the difference $V_2 - V_1$ is carried out in the CPU 8. If the absolute value of the difference $V_2 - V_1$ exceeds a predetermined acceptable value $C_o$, which is input from the coin kind setting switch 11 via the I/O interface 12, that is, $$|V_2 - V_1| > C_o \quad (1)$$

it is judged that the detected coin is a different kind of coin, and then the CPU 8 issues a different kind mixture signal. As a consequence, the discrimination process is stopped and an alarm circuit, not shown, is actuated to inform the operator that a different kind of coin is mixed in.

On the other hand, when the absolute value of the difference $V_2 - V_1$ is equal to or less than the acceptable value $C_o$, that is, $$|V_2 - V_1| \leqq C_o \quad (2)$$

the second coin is also dealt with as a genuine one and discharged into the counting bag.

In case of a third coin 2-3, the mean value $(V_1 + V_2)/2$ of the first maximum quantity of variation $V_1$ (the one before the preceding time) and the second maximum quantity of variation $V_2$ (the preceding time) is taken as the reference value. When the absolute value of difference between the maximum quantity of variation $V_3$ for this time and the reference value $(V_1 + V_2)/2$ exceeds the acceptable value $C_o$, the coin 2-3 is dealt with as a counterfeit one. Consequently, the processing of discrimination is stopped and an alarm is issued. When the absolute value of the difference is equal to or less than the acceptable value $C_o$, the coin 2-3 is dealt with as a genuine one and discharged into the counting bag.

Thereafter, similarly subsequent processings continue to be carried out. That is, when the n-th coin 2-n passes, the mean value of the maximum quantity of variation $V_{n-2}$ for two times before and the maximum quantity of variation $V_{n-1}$ for the previous time is considered to be the reference value. Where the absolute value of difference between the above-mentioned reference value and the maximum quantity of variation $V_n$ for this time exceeds the acceptable value $C_o$, that is, $$\left| V_n - \frac{V_{n-2} + V_{n-1}}{2} \right| > C_o \quad (3)$$

the CPU 8 discriminates the coin 2-n to be counterfeit. Consequently, the different kind coin mixture signal is issued to stop the discrimination process and to generate the alarm. On the other hand, in case where the absolute value is equal to or less than the acceptable value, that is, $$\left| V_n - \frac{V_{n-2} + V_{n-1}}{2} \right| \leqq C_o \quad (4)$$

the coin 2-n is discriminated to be genuine and then discharged into the counting bag. Although in the above-mentioned embodiment, the mean value of two previous maximum quantities of variation (for two times before and for the previous time) is considered to be the reference value, the mean value of three previous maximum quantities of variation, the mean value of four previous maximum quantities of variation . . . etc. may be adopted as the reference value. Furthermore, the acceptable value may be adapted to be varied in response to the switching of the coin kind setting switch 11. Thus, the coins of the kind which are made of material very similar to that of coins of another kind (for example, 50-yen coin and 100-yen coin, or 500-yen coin and 500-won coin) are to be discriminated, the acceptable value can be selected to be small. On the other hand, in the case of coins (for example 10-yen coins) which are not made of material similar to those of other kinds of coins, but vary widely the acceptable value can be selected to be large. Thus, the variation of the acceptable value in accordance with the kinds of coins can provide a stable coin discrimination.

As described above, the present invention can eliminate the effect of level deviation due to variation of temperature or from drift which varies relatively slowly in time since the mean value of maximum quantities of variation corresponding to the coins passing for several previous times is considered to be the reference value, and when the difference between the mean value and the maximum quantity of variation corresponding to the coin passing for this time exceeds the predetermined acceptable value, that coin is discriminated as counterfeit. Therefore, the present invention has an advantage in that a precise discrimination can be maintained.

What is claimed is:

1. A coin checking device for use in a coin handling machine for discriminating whether passing coins are genuine or counterfeit, said coin checking device comprising:

detection coil means for detecting an initial voltage and sequentially issuing a detection signal in accordance with the material properties of each of the passing coins, receiving and generating means for receiving each detection signal from the detection coils and generating a variation value representing a maximum quantity of variation from said initial voltage for each detection signal, storing means for storing each variation value, reading means for reading from the storing means at least two immediately preceding variation values and averaging said at least two immediately preceding variation values to obtain a renewable reference value prior to reading a new variation value from said storing means, first comparing means for comparing said renewable reference value with said new variation value to obtain a first difference therebetween, and second comparing means for comparing said first difference with an acceptable value to obtain a second difference and issue a different kind coin mixture signal when the second difference exceeds the first difference.

2. A device as set forth in claim 1 wherein the detection coils comprise a transmitting coil for generating a voltage and a receiving coil for generating an induced voltage, these coils being mounted opposite to each other so that said coils are arranged on the opposite sides of the coin path.

3. A device as set forth in claim 1 wherein the detection signals issued from the detection coils are converted into d.c. voltages by a d.c. converter, converted from analog to digital form by an analog/digital converter and then transferred to the receiving and generating means.

4. A device as set forth in claim 1, further comprising a coin kind setting switch associated with the second comparing means for varying the acceptable value in accordance with the kinds of coins.

* * * * *